United States Patent [19]

Howard

[11] 4,333,235

[45] Jun. 8, 1982

[54] CROSS SCISSORS/SHEARS

[76] Inventor: Marvin M. Howard, 5 Herron St., Bemis, Tenn. 38314

[21] Appl. No.: 233,787

[22] Filed: Feb. 12, 1981

[51] Int. Cl.[3] ..... B26B 13/20

[52] U.S. Cl. ..... 30/259

[58] Field of Search ..... 30/257, 259, 271, 262

[56] References Cited

U.S. PATENT DOCUMENTS

| | | | |
|---|---|---|---|
| 342,380 | 5/1886 | Orahood | 30/257 |
| 540,464 | 6/1895 | Stockmann | 30/259 X |
| 1,594,671 | 8/1926 | Isaac | 30/259 |
| 3,143,799 | 8/1964 | Gover | 30/259 |

*Primary Examiner*—Jimmy C. Peters

*Attorney, Agent, or Firm*—Richard L. Miller

[57] ABSTRACT

A pair of scissors or shears for allowing thin materials, being cut, to lay flat; the scissors or shears including a pair of crossing levers pivoted together, one end of the levers forming cutting blades, and the other end forming handles for being held in a hand, the handles being upwardly offset so to both be above the material being cut and thus not disturb the same from laying down flat upon a cutting table.

1 Claim, 5 Drawing Figures

CROSS SCISSORS/SHEARS

BACKGROUND OF THE INVENTION

It is well known to tailors, dress makers and sheet metal workers, that it is difficult to cut a correct pattern of thin material with a conventional pair of scissors or shears wherein one handle of the tool is obliged to be moved underneath the material, which thus disturbs the material from being kept flat while being cut. This is objectionable, because the material thus raised and being cut at a same time, results in a different cut shape thereto, than when it is laying flat; so that the material thus wrongly cut, may possibly be spoiled and wasted, or a garment made therewith, is ill-fitting.

SUMMARY OF THE INVENTION

Accordingly, it is a principal object of the present invention, to provide a scissors or shears that allow a user to cut a thin material with ease and accuracy while the material is remained in a flat, straight and smooth condition. Pressure from edges of material being cut, is relieved, allowing scissors or shears to move along smoothly, and the material edge passes over the lower blade and an offset while the other edge of the material passes under the upper blade.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows:

FIG. 1 is a side view of the invention shown with the cutting blades in a closed position.

FIGS. 2, 3, and 4 are cross sectional views taken on lines 2—2, 3—3, and 4—4 respectively, of FIG. 1.

FIG. 5 is a view similar to FIG. 1, shown in operative use cutting a cloth, with the blades being in open position.

DETAILED DESCRIPTION OF THE PREFERRED EMBODIMENT

Figure 1:
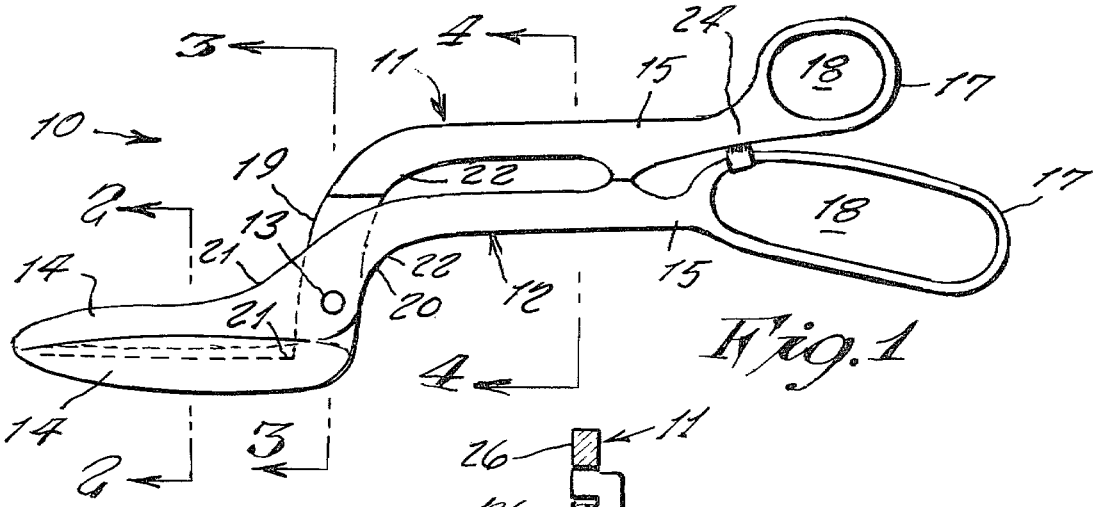

Referring now to the drawing in greater detail, the reference numeral 10 represents a cross scissors/shears according to the present invention wherein the implement is comprised of a pair of crossing levers 11 and 12 which are pivotally fastened together on a screw 13 through longitudinally intermediate portions of both levers. One end of both levers form co-operative cutting blades 14, while the other ends of both levers form co-operative handles 15 for being held in a hand of a person. The levers are preferably forged from a good quality of steel in order that a cutting edge 16 ground along one longitudinal edge of the blade will retain a sharpness for a long time use before requiring resharpening. Each handle is made into a loop 17 at its end, so as to form a hole 18 for receiving either a finger or a thumb of the hand; one hole accordingly being larger so as to receive a plurality of fingers.

The present invention differs from conventional scissors or shears wherein the both levers are generally straight. In the present invention, each lever is made with a double offset central portion 19 or 20, formed between two bends 21 and 22 (in opposite direction) which are of approximately equal angle in each of the levers, so that the blades are approximately parallel to its handles, but at an offset higher level thereto. As shown, the bends 21 and 22 of one lever need not be the same as the corresponding bends of the other lever.

The screw extends through the double offset central portions 19 and 20 of the levers.

Figure 2:
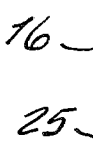
Figure 3:
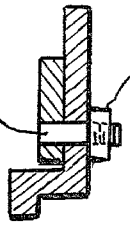
Figure 4:
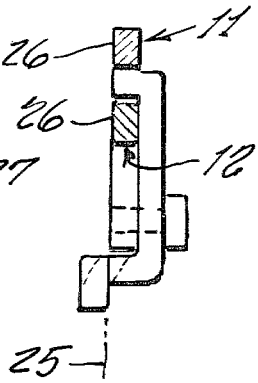

While the blades are positioned so as to pass adjacent each other during a shearing action, as shown in FIG. 2, while a protrusion 23 on each of the handles are aligned so to abut each other, so as to serve as stop that limit the closing of the implement. At a same time a rotatable ring around one of the handle loops abuts against a loop pile affixed on the other handle loop; the ring having a corresponding loop pile on one outer side portion thereof so as to be selectively engaged with the fixed loop pile as shown at 24, when the implement is wished to be retained in a safely closed position. It is to be noted that the levers are positioned alongside each other at the double offset portions 19 and 20, as shown in FIG. 3, and it is also to be noted that the shearing plane 25 between the blades is on a same plane as one side 26 of both the handles, as shown in FIG. 4, for purpose of allowing a better viewing of the cut while being made in the material.

A removable nut 27 is engaged on the pivot screw.

Figure 5:
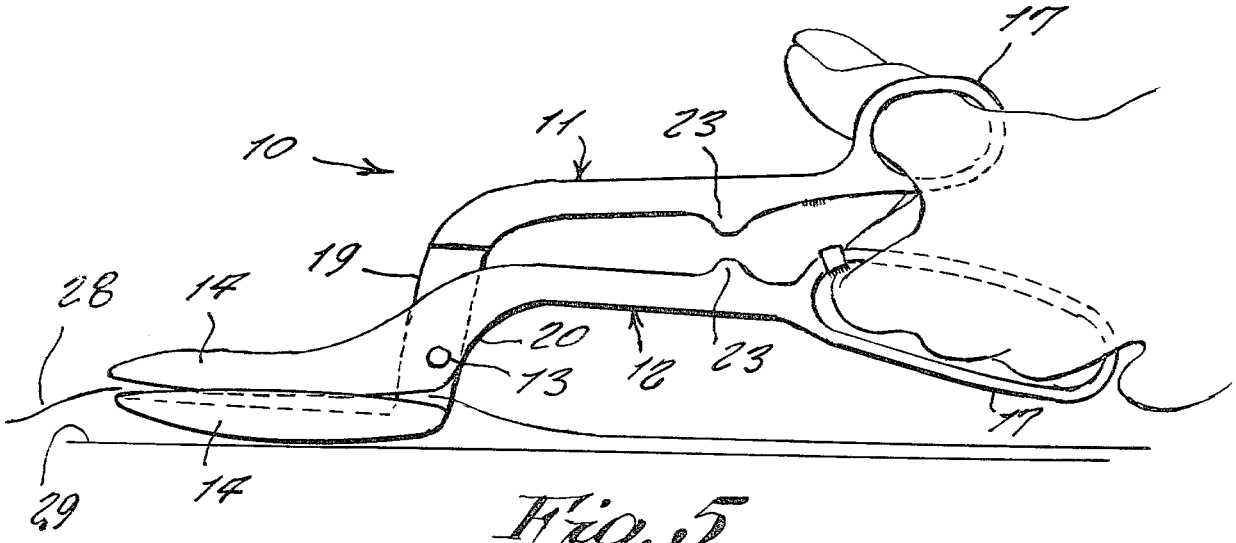

In operative use, as shown in FIG. 5, only the lower blade moves under a thin material 28 being cut, while both handles (and a hand holding them) move above the material, so that the material is thus only very minimally disturbed from its resting position upon a cutting surface 29. Thus by keeping the material flat, an accurate cut is made possible.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A double cross scissors/shears, comprising in combination, a pair of crossing levers having corresponding cutting blades at one end and corresponding handles at an opposite end, a pivot screw holding said levers together, and a double offset intermediate portion on each said lever, said pivot screw being through said double offset portions; each said double offset portion being formed by a pair of bends in opposite directions, so that said handles are both at a higher elevation than said blades, when in use cutting a material laid flat on a cutting surface; a protrusion on each said handle abutting each other when said scissors/shears are in a closed position; each said handle including a loop around a hole for receiving either a thumb or the fingers of a persons hand, a rotatable ring around one said loop having loop pile on a portion of an outer side thereof which in one rotated position abuts a corresponding loop pile stationarily affixed on the other said handle loop, when said scissors/shears are in said closed position.

* * * * *